US008058976B2

(12) United States Patent
Ortiz et al.

(10) Patent No.: US 8,058,976 B2
(45) Date of Patent: Nov. 15, 2011

(54) DOG BARK DOOR BELL NOTIFICATION AND PERSONAL PROTECTION SYSTEM

(76) Inventors: Melisendro T. Ortiz, Albuquerque, NM (US); Luis M. Ortiz, Albuquerque, NM (US)

( * ) Notice: Subject to any disclaimer, the term of this patent is extended or adjusted under 35 U.S.C. 154(b) by 0 days.

(21) Appl. No.: 12/714,172

(22) Filed: Feb. 26, 2010

(65) Prior Publication Data

US 2010/0148957 A1 Jun. 17, 2010

Related U.S. Application Data

(63) Continuation of application No. 11/818,690, filed on Jun. 15, 2007, now Pat. No. 7,683,800.

(51) Int. Cl.

| | |
|---|---|
| ***G08B 3/00*** | (2006.01) |
| ***G08B 3/10*** | (2006.01) |
| ***G08B 23/00*** | (2006.01) |
| ***G08B 1/08*** | (2006.01) |

(52) U.S. Cl. ..... 340/328; 340/384.73; 340/573.3; 340/691.2; 340/692; 340/539.26

(58) Field of Classification Search ..... None
See application file for complete search history.

(56) References Cited

U.S. PATENT DOCUMENTS

| | | | | |
|---|---|---|---|---|
| 3,740,737 | A * | 6/1973 | Carleson | 340/521 |
| 3,886,352 | A * | 5/1975 | Lai | 250/215 |
| 4,520,501 | A * | 5/1985 | DuBrucq | 704/271 |
| 4,764,953 | A * | 8/1988 | Chern et al. | 379/355.01 |
| 5,886,631 | A * | 3/1999 | Ralph | 340/541 |
| 6,927,687 | B2 * | 8/2005 | Carrender | 340/539.26 |
| 7,173,534 | B1 * | 2/2007 | Markham et al. | 340/573.2 |
| 7,683,800 | B2 * | 3/2010 | Ortiz et al. | 340/691.2 |
| 2003/0043047 | A1 * | 3/2003 | Braun | 340/691.1 |
| 2003/0080855 | A1 * | 5/2003 | Koneff et al. | 340/328 |
| 2005/0005873 | A1 * | 1/2005 | Gick | 119/707 |
| 2006/0038663 | A1 * | 2/2006 | Steinetz et al. | 340/392.1 |
| 2009/0010466 | A1 * | 1/2009 | Haikonen | 381/315 |

* cited by examiner

*Primary Examiner* — Jennifer Mehmood
*Assistant Examiner* — Fekadeselassie Girma
(74) *Attorney, Agent, or Firm* — Ortiz & Lopez, PLLC

(57) ABSTRACT

A security system includes a warning notification module adapted to recognize at least one of a wireless or audible signal. A door bell ringer or emergency transmission signal from a wireless transmitter can provide a recognition signal to a microprocessor in the security system via the warning notification module. The microprocessor retrieves dog barking sounds stored in memory and provides them to at least one of an amplifier or radio frequency transmitter after the microprocessor receives the recognition signal from the warning notification module. Dog barking sounds can be broadcasted using the wireless transmitter. Processing can be with a time delay after first receipt of the recognition signal. A random module can enable random retrieval of various dog barking sounds from memory for processing. A time out module can disable operation of the microprocessor at a set time after recognition signal receipt.

11 Claims, 7 Drawing Sheets

DOG BARK DOOR BELL NOTIFICATION AND PERSONAL PROTECTION SYSTEM

INVENTION PRIORITY

The present application is a continuation of and claims priority to U.S. patent application Ser. No. 11/818,690, filed Jun. 15, 2007, now U.S. Pat. No. 7,683,800 now issued, which is hereby incorporated by reference for its teaching.

TECHNICAL FIELD

The present invention is generally related to alarm system technology. The present invention is also generally related to door bell systems. More particularly, the present invention is related to a system adapted for deterring burglary and personal threats with an electronic dog barking technology that can be enabled in response to a wireless transmitter or door bell sounds.

BACKGROUND

Door bells are in wide use at personal residences and some businesses to notify occupants about the arrival of a guest or solicitor. Door bell ringers are typically located on the outer perimeter of an exterior front door frame to a residence, where it can be easily located by a visitor. Although many door bells have been hard-wired from the switch located at the front door to the actual door bell in a hallway, entry, or the like, many modern door bell systems are being provided as wireless, battery operated devices adapted to transmit a wireless signal to a companion (or matching) receiving device that includes a speaker for electronically announcing a ring tone as notification that a visitor has arrived and is waiting outside the front door.

Referring to FIGS. 1A and 1B, both labeled as "prior art", a modern, wireless door bell system is illustrated. A modern door bell ringer 10 is typically battery powered and can be mounted to the outer exterior of a doorway for a dwelling. The door bell ringer has a plunger switch 15 that activates a radio frequency transmitter 17 when it is pressed by a visitor. A radio frequency signal is transmitted from the door bell ringer 10 with a specific frequency, or bearing a specific code. The frequency or code is set by a code module 19. In some transmitters, the code is set by a series of dip switches, which are known in the art. The unique signal sent by the door bell ringer 10 is received by a door bell 20 located within the dwelling within hearing range of the dwelling's occupants. As shown in FIG. 1B, the door bell 20 includes a radio frequency receiver 21 adapted by a companion code module 22 adapted to recognize the unique signal transmitted by the door bell ringer 10. If the unique signal, e.g., code, is recognized, a microprocessor enables a ring tone stored in a memory 23 to be amplified 27 and announced through a speaker 29.

Although door bells have proven to be very useful to occupants of a residence as well as guests/solicitors trying to notify residents that the guest/solicitor is waiting outside the exterior door, it is possible that criminals may also be calling in order to "case", or otherwise assess the vulnerability of and the value of contents within, a home or business. If the door bell is answered, the criminal can achieve the objective of assessing the dwelling, size up the occupants and determine whether alarms or pets are employed for security purposes. Most alarms have a "chime" feature that can make occupants aware that a door has been opened. A criminal can also hear the chime sounding when the front door is opened. A real, live dog typically barks whenever a door bell is rang. This too can be heard by a criminal with bad intent. As part of casing a home or business, the criminal is likely to pass on a dwelling that is protected by alarms or pets for just a routine burglary and look for a "softer" target.

The present inventors realize that protection of one's self and property is enhanced where barking dogs are present in a dwelling; unfortunately, it is not always convenient to own a live dog where home owners are routinely away from their residence for long periods of time, or where it is too burdensome to care for a pet. For these reasons, the present inventors have developed an electronic door bell notification and personal protection system that will enable the sounds of a barking dog shortly after the ringing of a doorbell, or by the activation of a portable, wireless transmitter.

SUMMARY OF THE INVENTION

In accordance with features of the present invention, a door bell notification and personal protection system includes a warning notification module adapted to recognize at least one of a door bell notification from a door bell ringer or emergency transmission signal from a wireless transmitter and thereafter provide a recognition signal to a microprocessor. The microprocessor is adapted to retrieve dog barking sounds stored in a memory and provide the dog barking sounds to at least one of an amplifier or radio frequency transmitter after the microprocessor receives the recognition signal from the warning notification module. Dog barking sounds can then be announced by a speaker that is either associated with the system or by a remote audio system.

In accordance with another feature of the present invention, dog barking sounds can be broadcast to a radio receiver using the tunable wireless transmitter.

In accordance with yet another feature of the present invention, a delay module can enable processing with a delay time after first receipt of the recognition signal.

In accordance with yet another feature of the present invention, a random module can enable random retrieval and processing of various dog barking sounds.

In accordance with another feature of the present invention, a time out module can disable operation of the system at a set time after recognition signal receipt.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DETAILED DESCRIPTION OF THE INVENTION

Figure 1A:
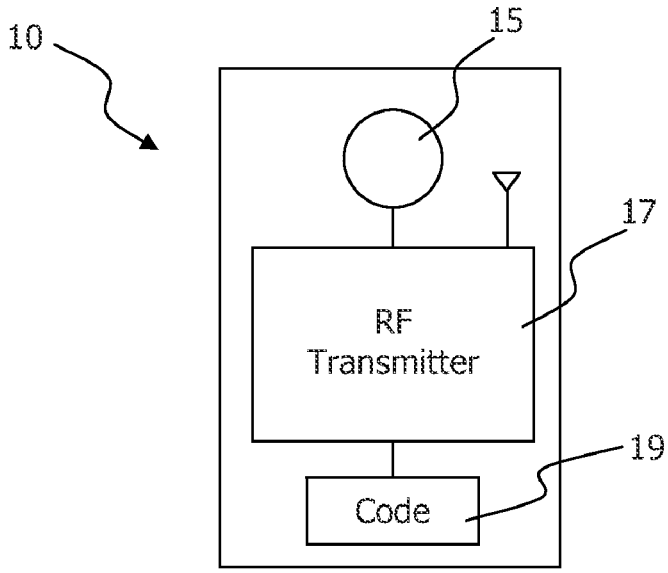
FIG. 1A PRIOR ART
FIG. 1A illustrates a "prior art" door bell ringer with a wireless transmitter adapted to transmit a unique signal.
Figure 1B:
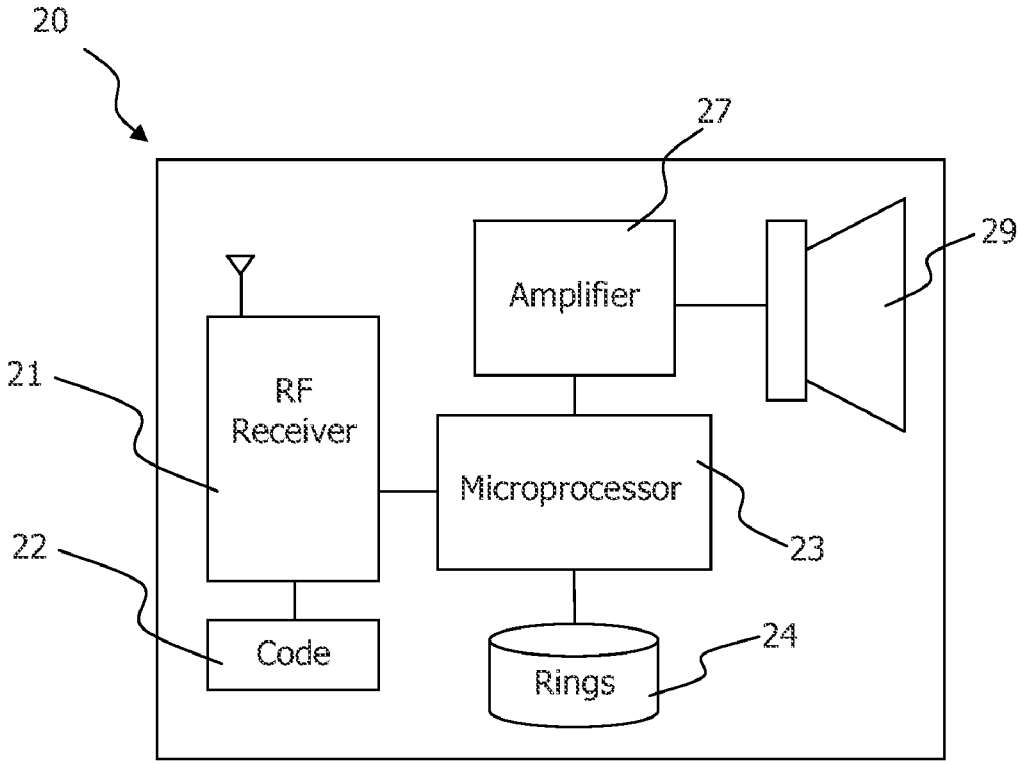
FIG. 1B PRIOR ART
FIG. 1B illustrates a "prior art" door bell with a wireless receiver adapted to respond to the unique signal transmitted from the wireless transmitter of FIG. 1A and to announce an electronic ring tone upon receiving the unique signal.
Figure 2:
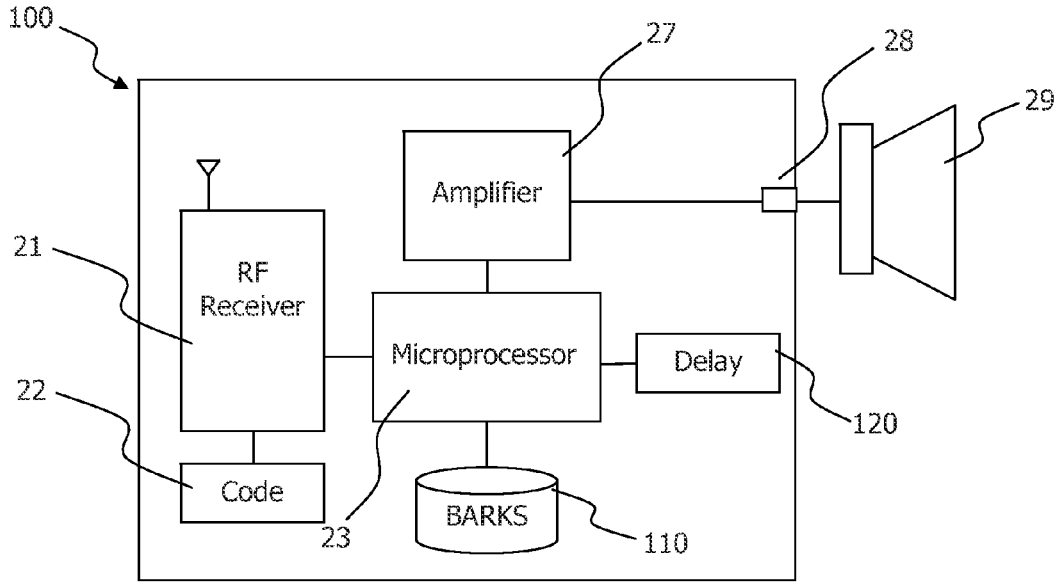
FIG. 2 illustrates a door bell notification and personal protection system, in accordance to features of the present invention, that is responsive to wireless transmitters including wireless transmitters associated with prior art door bell ringers by announcing an electronic dog bark.

Referring to FIG. 2, illustrated is a door bell notification and personal protection system 100 in accordance to features of the present invention. The door bell notification and personal protection system 100 is responsive to wireless transmitters, including wireless transmitters associated with prior art door bell ringers, by announcing electronic dog barking sounds. A radio frequency receiver 21 is adapted by a companion code module 22 to recognize a unique signal transmitted by a radio frequency transmitter 10, such as the door bell ringer 10 shown in FIG. 1A, or from a panic button provided in the form of a wireless transmitter attached to a "key fob" which is a device typically used in the security alarm industry for user to quickly notify authorities of a break in or emergency at a residence. If the unique code is recognized, a microprocessor 23 enables an electronic dog barking sounds stored in a memory 110 to be accessed and amplified by an amplifier 27 where after the sounds are announced through a speaker 29. A delay module 120 can delay the rendering of dog barking sounds by the microprocessor 23, so that the dog barking sounds are not announced simultaneously with the door bell ringing. A short delay of, for example, 1 or more seconds is typically experienced after a door bell sound is produced before real dogs respond; therefore a similar delay (e.g., at least one second) is preferable for the present system 100.

The speaker 29 can be integrated within the system 100 or an audio plug 28 can enable a broader frequency range audio system to be connected to the system 100. Loudspeakers and/or sub-woofers can easily be built into the personal protection system as is known in the art, but an alternative audio plug provides additional flexibility to plug remote speakers, or wireless speakers, into an adapter 28 provided in the system, thereby extending the effective range of dog bark noises emanating from the system 100. The adapter, for example, can enable the system to be plugged into a stereo system, which typically has a broader audio frequency range useful to mimic the deep, vicious bark rendered by very large dogs (e.g., Rottweiler, German Sheppard) at sufficiently high volume.

Figure 3:
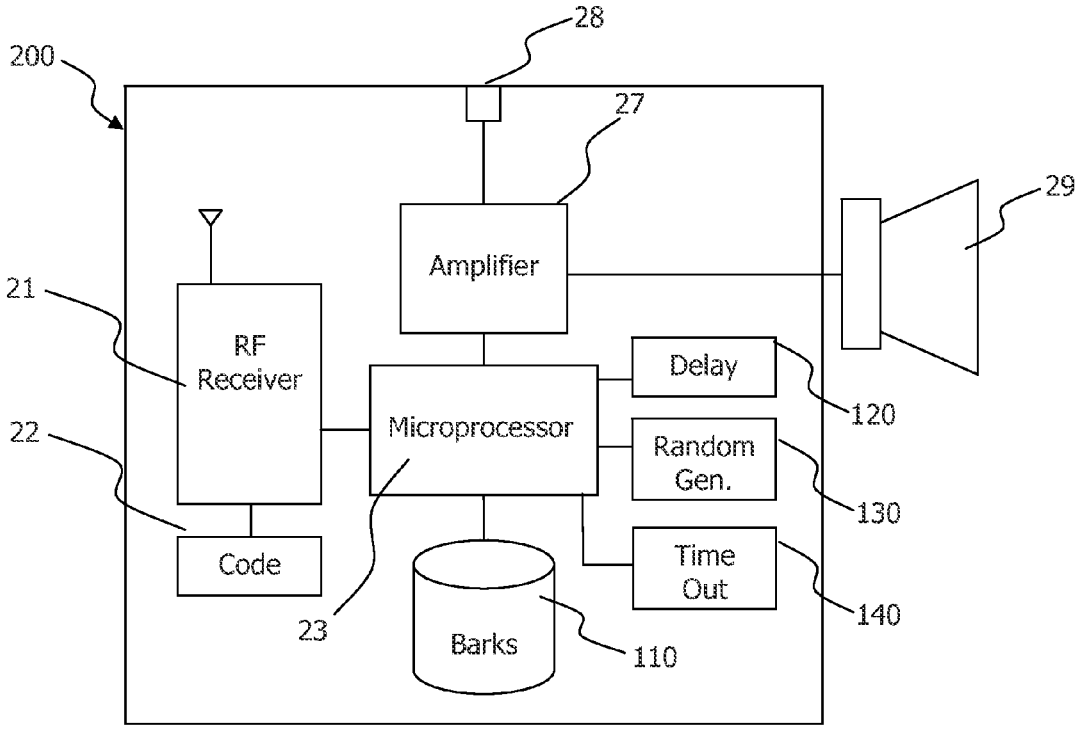
FIG. 3 illustrates a door bell notification and personal protection system, in accordance with features of the present invention, that is responsive to wireless transmitters including wireless transmitters that are associated with prior art door bell ringers by announcing an electronic dog bark.

Referring to FIG. 3, illustrated is a door bell notification and personal protection system 200 in accordance to additional features of the present invention. In addition to features described with respect to FIG. 2, the door bell notification and personal protection system can include a random generator module 130 with operates with the microprocessor 23 to retrieve variations of dog barking sounds from the memory 110. Variation of dog barking sounds would be more effective to trick a would-be burglar to believe that a live dog exists within the dwelling. Variations can include different dock bark patterns, fading or intensifying dog barking, different types of dogs barking. Also shown in FIG. 3 is a time out module 140 that can be included in the system 200. The time out module 140 can operate in coordination with the microprocessor 23 to stop dog barking noises at a fixed time after door bell notification has stopped. For example, dogs may bark for a few minutes after hearing a door bell ring in a dwelling. Ideally, the system 200 will continue producing dog barking sounds for more than one minute (and perhaps up to two minutes) in order to trick a would-be burglar into believing that a live dog exists within the dwelling. Time out module 140 can be implemented electronically by the microprocessor or by using a supplementary timing circuit. Timing circuits and/or programming enabling a "time out" condition are known.

Figure 4:
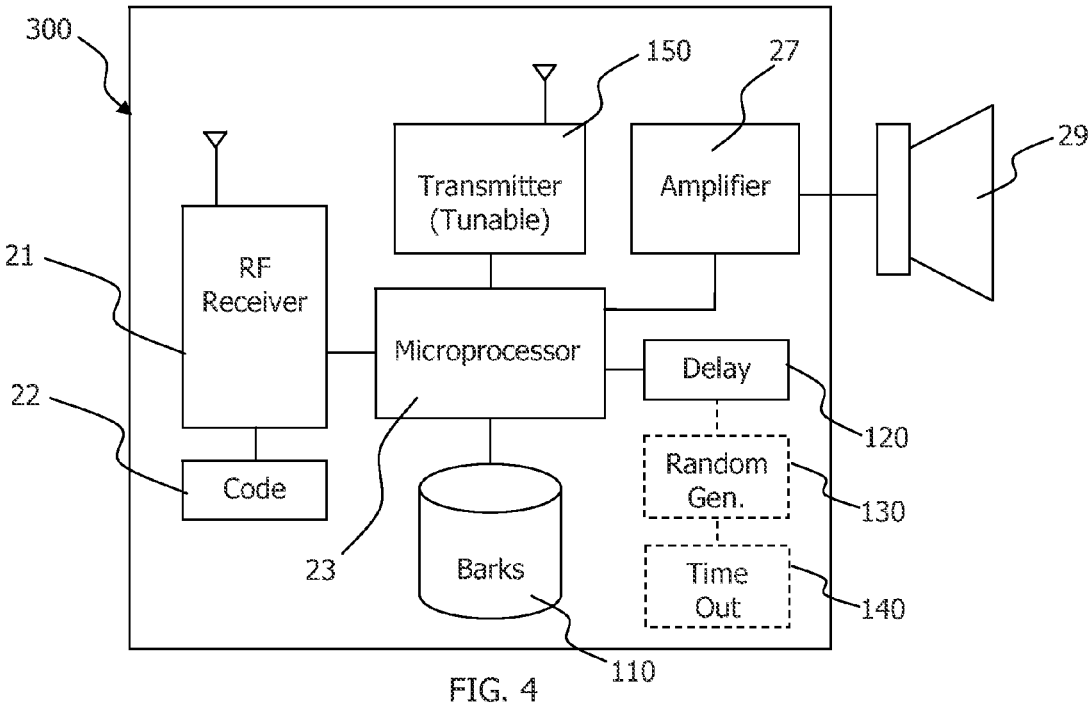
FIG. 4 illustrates a door bell notification and personal protection system, in accordance with features of the present invention, responsive to wireless transmitters including wireless transmitters associated with prior art door bell ringers by announcing an electronic dog bark and adapted to transmit signals to supplemental electronic equipment.

Referring to FIG. 4, illustrated is a door bell notification and personal protection system 300 in accordance to additional features of the present invention. In addition to features described with respect to FIGS. 2 and 3, the door bell notification and personal protection system 300 shown in FIG. 4 can include a radio frequency transmitter 150 adapted to transmit and coordinate dog barking signals or system 300 activation to additional electronic systems (e.g., additional dog barking system, security alarms, radios, etc.). For example, the transmitter can be adapted with a tuner to broadcast dog bark sounds accessed from memory 110 by the microprocessor 23 at multimedia systems adapted to receive radio broadcasts in AM (amplitude modulation) and FM (frequency modulation) formats. An AM/FM radio or stereo (not shown) can be tuned to a specified AM/FM frequency wherein it can receive the broadcasted dog barking sounds generated by the system 300. Alternatively, the system can broadcast a unique signal to a companion door bell notification and personal protection system (e.g., 200) adapted to render dog barking sounds at a different location within the dwelling. The companion door bell notification and personal protection system can be set with delays and different dog barking sounds than the door bell notification and personal protection system 400 that provides and/or processes initial notification.

Figure 5:
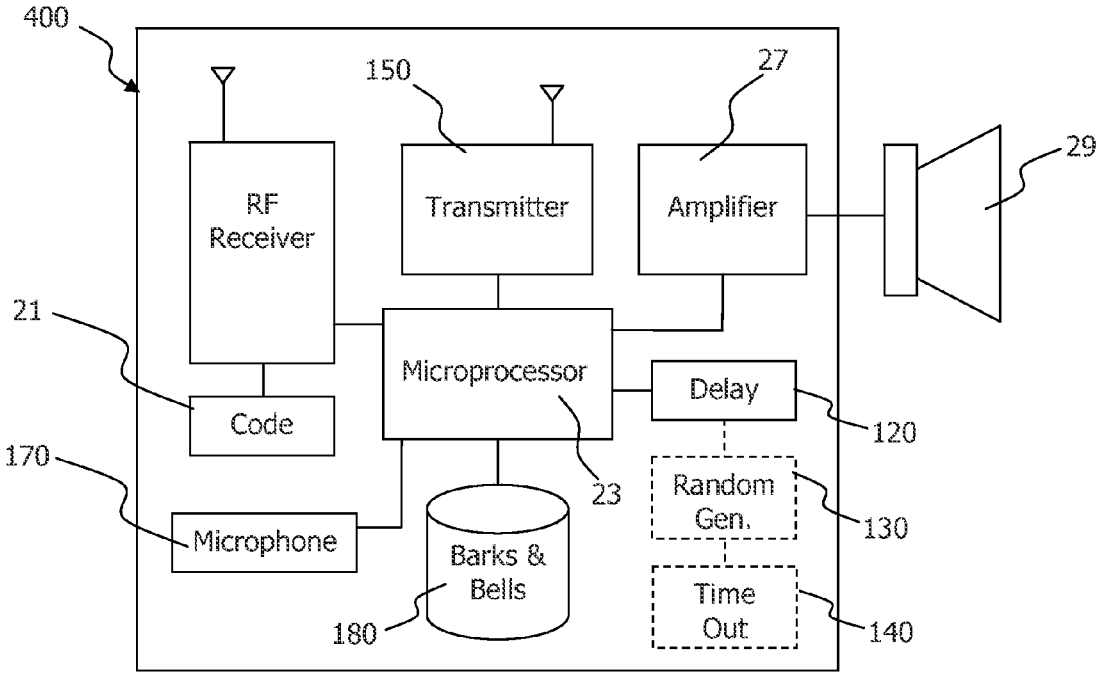
FIG. 5 illustrates a door bell notification and personal protection system, in accordance with features of the present invention, responsive to unique sounds and/or responsive to wireless transmitters including wireless transmitters associated with prior art door bell ringers by announcing an electronic dog bark and adapted to transmit signals to supplemental electronic equipment.

Referring to FIG. 5, illustrated is a door bell notification and personal protection system 400 in accordance to additional features of the present invention. In addition to features described with respect to FIGS. 2, 3 and 4, the door bell notification and personal protection system 400 shown in FIG. 5 can include a microphone 170, which can be adapted to activate dog barking sounds if recognized sounds are identified by the system 400. For example, the memory 180 can store various dog barking sounds and can also store sounds that the system must listen for using the microphone 170 before dog barking sounds are rendered by the microprocessor 23. This feature enables the system 400 to operate with older door bells that are hardwired within the dwelling. Older door bell systems do not utilize a wireless transmitter; therefore, the present system 400 can be programmed to identify the door bell sound produced by the existing, hard-wired door bell system, and then the door bell notification and personal protection system 400 can produce dog barking sounds from memory 180. The delay module 120, random generator module 130, time out module 140 and transmitter 150 can operate with the present system as previously described.

Figure 6A:
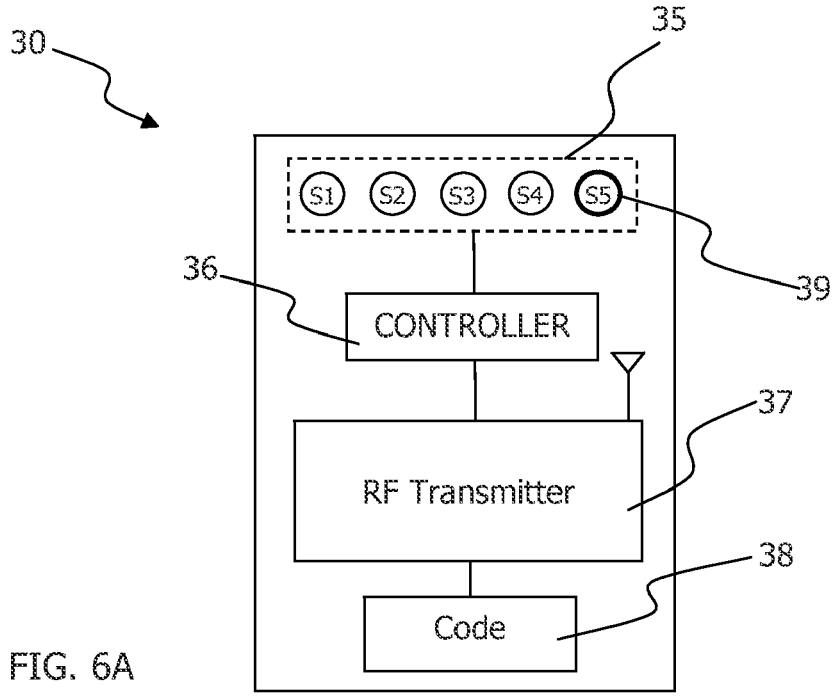
FIG. 6A illustrates system modules for a portable transmitter in accordance with features of the present invention.
Figure 6B:
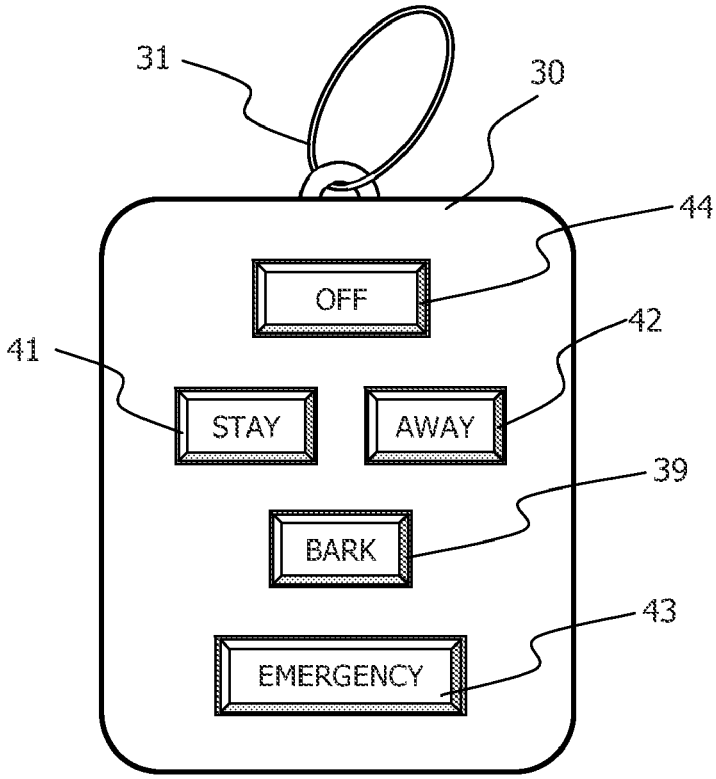
FIG. 6B illustrates system features for a portable transmitter presented in the form of a "key fob" in accordance with features of the present invention.

Referring to FIGS. 6A and 6B, an improved portable transmitter 30 in the format of a well-known "key fob" is illustrated. Most residential alarm companies are offering key fobs as an option for residents to easily arm or disarm alarm systems, and to render emergency help. As shown in FIG. 6A, a portable transmitter 30 in accordance with features of the present invention includes switches 35, a controller 36, a radio frequency transmitter 37 and a code module 38. Switch S5 is highlighted and indicated with numeral 39 because it is assigned "dog barking" functionality Switch S5, when activated, will operate with the door bell notification and personal protection systems 100-400 described above to produce dog barking sounds. As shown in FIG. 6B, and exemplary exterior design and button layout is illustrated for a suggested the portable transmitter 30 design. The portable transmitter 30 would ideally be small enough to fit in a pocket. A key ring 31 can be attached to the portable transmitter 30 so that house keys, and the like, can be attached to the portable transmitter 30. The portable transmitter 30 has buttons 41-44 typically associated with residential alarm functions. Button 41 is used to place an alarm in the "STAY" mode of operation, which typically allows a residence to remain within the residence while exterior entry points are placed in an armed state. Button 42 is used to place the alarm system in "AWAY" mode of operation, which arms all sensors associated with the alarm including internal motion sensors. Button 43 is used to activate the alarm system's "EMERGENCY" operation, which will call for emergency help when a resident is in need of assistance. Button 44 is the "OFF" button, which is used to cancel or deactivate armed and emergency states in the alarm system. In accordance with enabling features of the present invention, button 39 (associated with S5 in FIG. 6A), labeled "BARK" in the illustration, can be used to initiate dog barking the door bell notification and personal protection systems 100-400 described above. It can also be appreciated that dog barking can be carried out by the residential alarm system (not shown) incorporating features of the present invention therein. This is logical given the teaching herein because residential alarm systems are already provided with programming features and loud speaker announcement capabilities. It can now be appreciated that a secondary code module (e.g., like code module 22) can be included that is setup to recognize a signal transmitted from a personal security transmitting device, such as a "key fob" adapted with a panic button that is now provided by home security alarm company for users to call for emergency help from anywhere within their residence.

Figure 7:
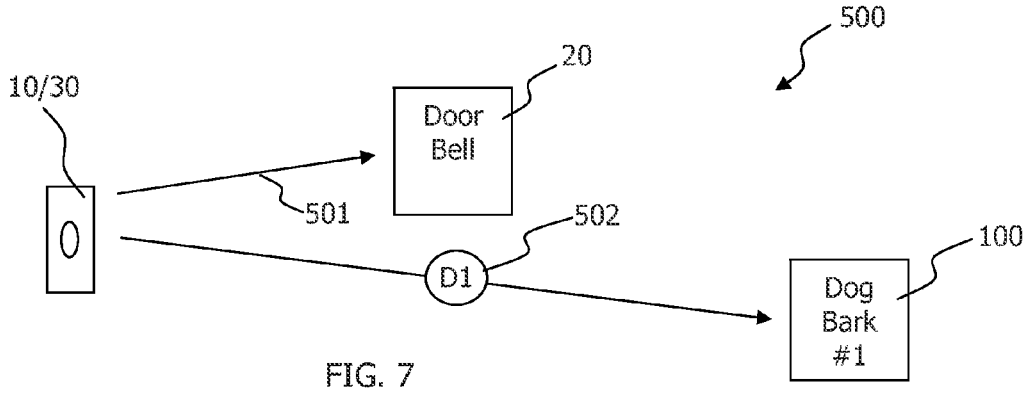
FIG. 7 illustrates a flow diagram for operation of a door bell notification and personal protection system responsive by the production of electronic dog barking to wireless transmitters including wireless transmitters associated with prior art door bell ringers, in accordance with features of the present invention.

Referring to FIGS. 7-11, various flow diagrams for the operation of a door bell notification and personal protection system responsive by the production of electronic dog barking to wireless transmitters including wireless transmitters associated with prior art door bell ringers are shown in accordance with features of the present invention. Referring to FIG. 7, a flow diagram 500 illustrates a wireless transmitter 10 that is activated by a user, which then transmits a signal 501 that causes a door bell 20 to ring. After a short delay 502, a door bell notification and personal protection system 100 sounds dog barking sounds. It should be appreciated that the door bell notification and personal protection system 100 can also be caused to render dog barking sounds by activation of a wireless transmitter 30, without use of the actual door bell 20. Such an alternate scenario would be employed when a user wants to activate dog barking noises for personal protection, but does not require the door bell to ring also.

Figure 8:
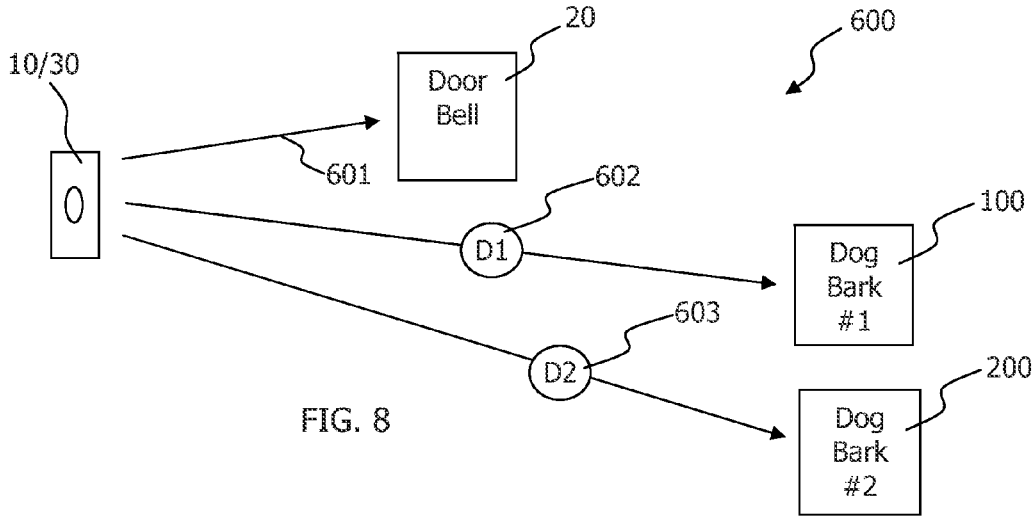
FIG. 8 illustrates a flow diagram for operation of a door bell notification and personal protection system responsive by the production of electronic dog barking to wireless transmitters including wireless transmitters associated with prior art door bell ringers, in accordance with features of the present invention.

Referring to FIG. 8, illustrates a flow diagram 600 for operation of a door bell notification and personal protection system 100/200, responsive by the production of electronic dog barking to wireless transmitters 10/30 including wireless transmitters associated with prior art door bell ringers, in accordance with features of the present invention. As shown in FIG. 8, a wireless transmitter 10/30 sends a signal to a door bell 20 and also to door bell notification and personal protection system 100 and door bell notification and personal protection system 200. Door bell notification and personal protection system 100 will produce dog barking sounds after a first delay 602. Door bell notification and personal protection system 200 will then produce dog barking sounds after a second delay 603. Two systems can produce alternate sounds and alternate locations for enhanced security.

Figure 9:
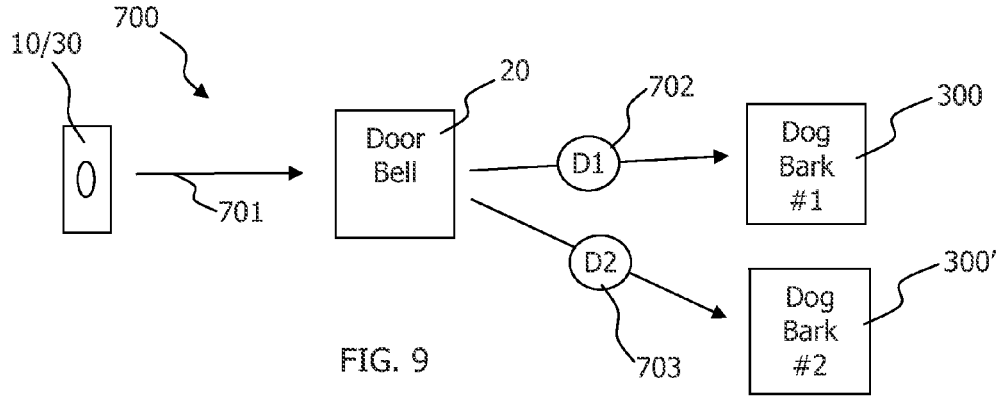
FIG. 9 illustrates a flow diagram for operation of a door bell notification and personal protection system responsive by the production of electronic dog barking to unique sounds and/or wireless transmitters including wireless transmitters associated with prior art door bell ringers, in accordance with features of the present invention.

As shown in FIG. 9, a flow diagram 700 indicates operation of a door bell notification and personal protection systems 300 and 300' after activation of a door bell 20 by a door bell ringer 10. It should be appreciated that the door bell ringer 10 and door bell 20 shown in FIG. 9 can be hard-wired system as typically used in older homes or with wired systems. Therefore, the door bell notification and personal protection systems 300 and 300' are adapted with microphones to be programmed to recognize unique sounds produced by the door bell 20. Once the door bell's sound is recognized by door bell notification and personal protection systems 300 and 300', each will begin rendering dog barking noises after delay 702, 703, associated with each door bell notification and personal protection systems 300, 300', respectively.

Figure 10:
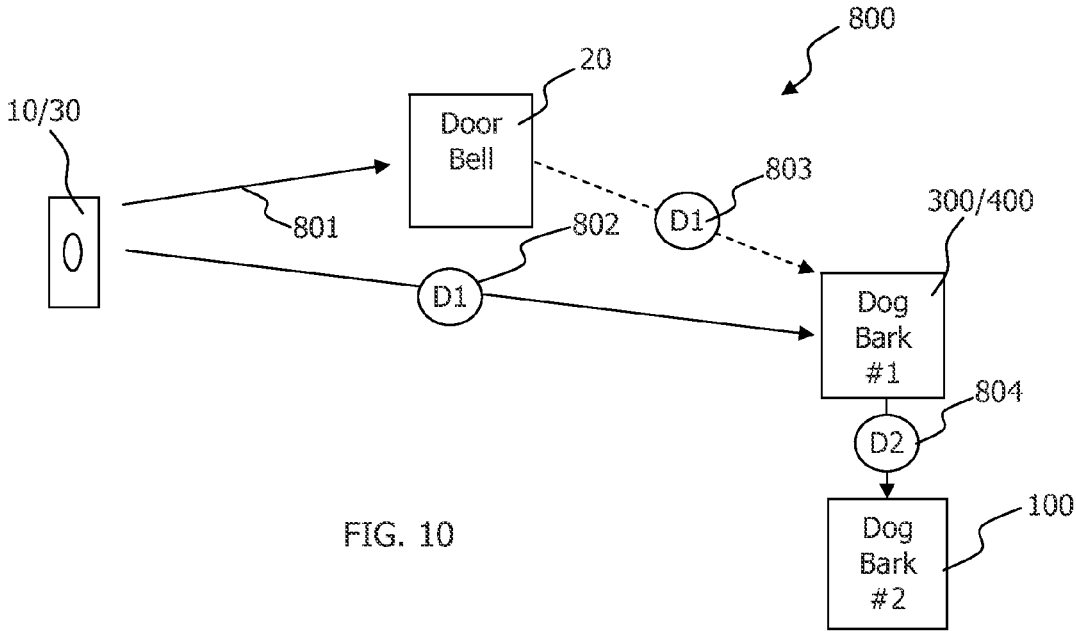
FIG. 10 illustrates a flow diagram for operation of a door bell notification and personal protection system responsive by the production of electronic dog barking to unique sounds and/or wireless transmitters including wireless transmitters associated with prior art door bell ringers, in accordance with features of the present invention.

FIG. 10 illustrates a flow diagram 800 for operation of a door bell notification and personal protection systems 100, 300, 400 responsive to door bell notifications by the production of electronic dog barking. The flow diagram 800 indicates that either direct wireless transmission from a door bell ringer 10 or audio notification/recognition from a ringing door bell 20 can cause door bell notification and personal protection system 300/400 to activate. Then after a short delay, or under the direction of the door bell notification and personal protection system 300/400, a secondary door bell notification and personal protection system 100 can be activated.

Figure 11:
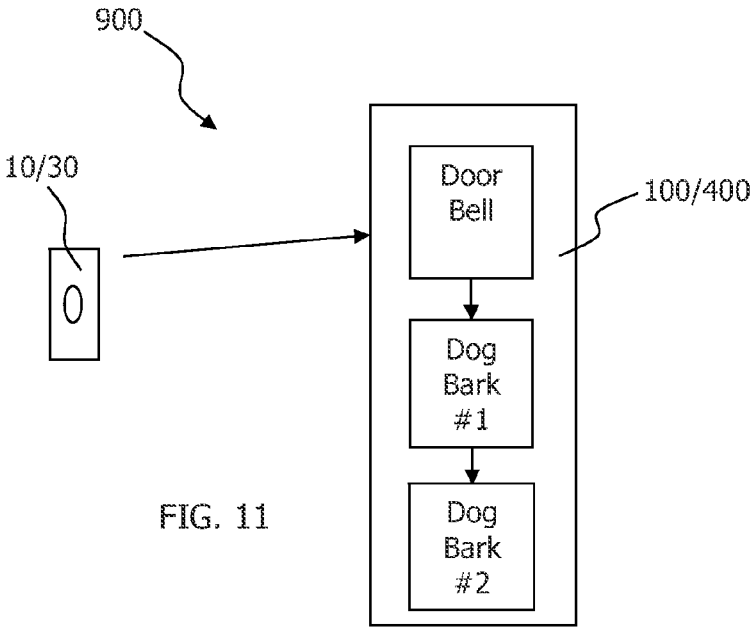
FIG. 11 illustrates a flow diagram for operation of a door bell notification and personal protection system responsive by the production of electronic dog barking to unique sounds and/or wireless transmitters including wireless transmitters associated with prior art door bell ringers, in accordance with features of the present invention.

FIG. 11 illustrates a flow diagram 900 for operation of a door bell notification and personal protection system 100/400. As shown in FIG. 10, door bell ringing and at least one dog barking feature can be provided by a single system 100/400 after activation by a door bell ringer 10 or key fob 30. Dog barking modules #1 and #2 are shown integrated with an electronic doorbell module as a consolidated system. Such a system can be easily manufactured and sold, with dog barking features activated or inactivated by a user.

Figure 12:
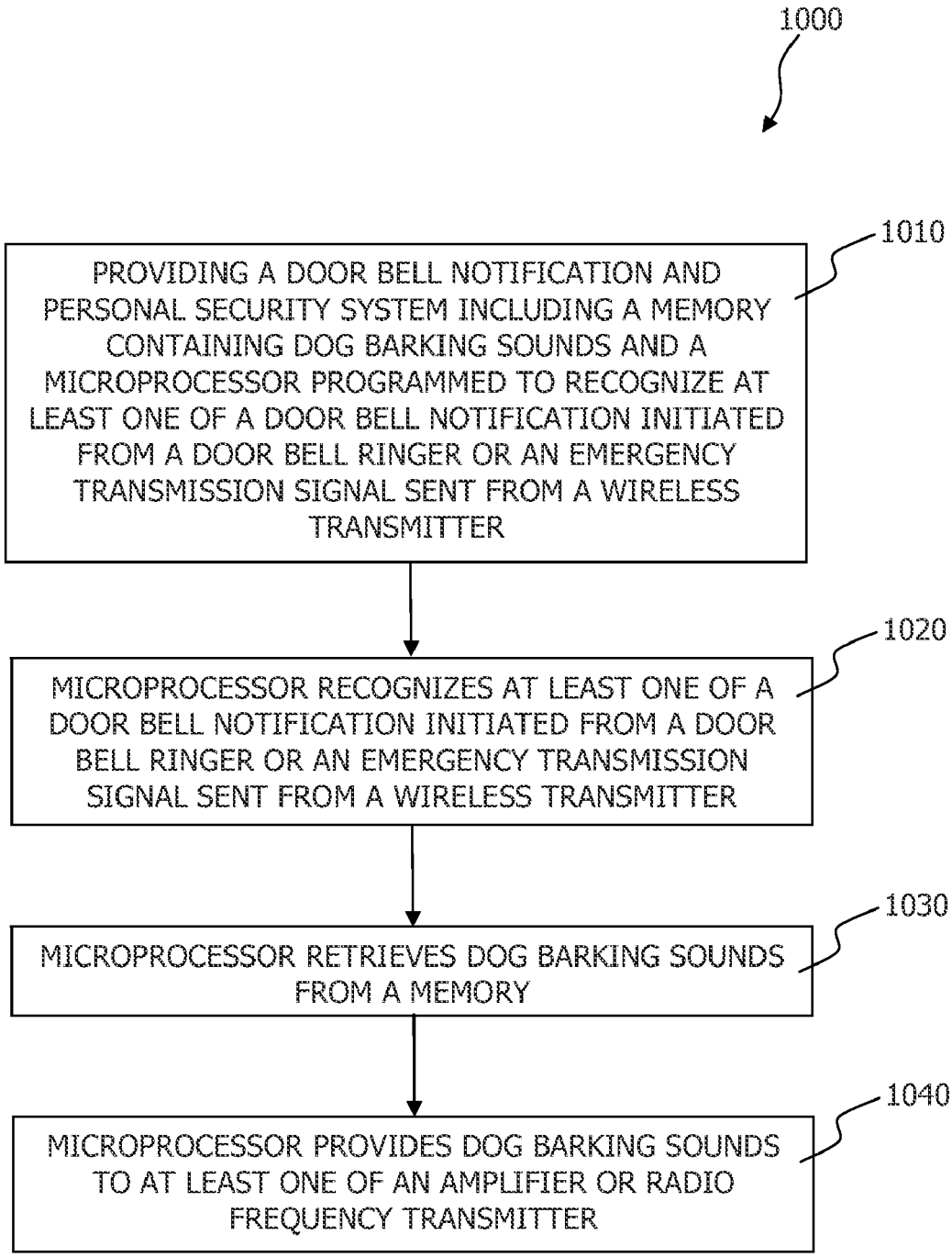
FIG. 12 illustrated a flow diagram of a method of using the present invention in accordance with some of its features.

Referring to FIG. 12, illustrated is a flow diagram 1000 of a method for providing door bell notification and personal security to occupants of a residence in accordance with features of the present invention. As shown in Block 1010, a door bell notification and personal security system including a memory containing dog barking sounds and a microprocessor programmed to recognize at least one of a door bell notification initiated from a door bell ringer or an emergency transmission signal sent from a wireless transmitter is provided. Then as shown in Block 1020, the microprocessor recognizes at least one of a door bell notification initiated from a door bell ringer or an emergency transmission signal sent from a wireless transmitter. Then as shown in Block 1030, the microprocessor retrieves dog barking, sounds from a memory. Finally, as shown in Block 1040, the microprocessor provides dog barking sounds to at least one of an amplifier or radio frequency transmitter.

Note that the embodiments disclosed herein can be implemented in the context of a host operating system (e.g., controller/microprocessor) and one or more hardware or software modules. Such modules may constitute hardware modules, such as, for example, electronic sensors, tuners and other components. Such modules may also constitute software modules. In the computer programming arts, a software module can be typically implemented as a collection of routines and data structures that performs particular tasks or implements a particular abstract data type.

Software modules generally comprise instruction media storable within a memory location of an image-processing apparatus and are typically composed of two parts. First, a software module may list the constants, data types, variable, routines and the like that can be accessed by other modules or routines. Second, a software module can be configured as an implementation, which can be private (i.e., accessible perhaps only to the module), and that contains the source code that actually implements the routines or subroutines upon which the module is based. The term module, as utilized herein can therefore refer to software modules or implementations thereof. Such modules can be utilized separately or together to form a program product that can be implemented through signal-bearing media, including analog and digital transmission media and recordable media.

It is important to note that, although the present invention is described in the context of a fully functional electronic apparatus (e.g., a computer system), those skilled in the art will appreciate that the mechanisms of the present invention are capable of being distributed as a program product in a variety of forms, and that the present invention applies equally regardless of the particular type of signal-bearing media utilized to actually carry out the distribution. Examples of signal bearing media include, but are not limited to, recordable-type media such as EPROMS (erasable programmable read-only memory), flash memory and transmission-type media such as analogue or digital communications links.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A security system comprising:

a portable transmitter sized for carriage in a clothes pocket of a person wherein the person manipulates the portable transmitter to thereby cause the portable transmitter to emit an emergency transmission signal;

a warning notification module that produces a recognition signal after receiving and recognizing the emergency transmission signal;

a memory containing a plurality of dog barking sound recordings;

a microprocessor that retrieves a dog barking sound recording from the memory and provides the dog barking sound recording to at least one of an amplifier or radio frequency transmitter after the microprocessor receives the recognition signal; and a random module, wherein the random module cooperates with the microprocessor to randomly select which of the dog barking sound recordings the microprocessor retrieves from the memory;

a microphone, wherein a doorbell sound is produced when a doorbell is actuated, wherein the microphone senses the doorbell sound and wherein the microphone operates with the microprocessor and the memory to produce the recognition signal upon recognizing the door bell sound; and a delay module that causes a time delay between sensing the door bell sounds and providing the dog barking sound recordings.

2. A security system, comprising:

a warning notification module that recognizes an emergency transmission signal sent from a remote wireless transmitter, and that thereafter provides a recognition signal to a microprocessor;

a memory containing dog barking sounds;

a microprocessor that retrieves dog barking sounds from the memory and provides the dog barking sounds to at least one of an amplifier or radio frequency transmitter after the microprocessor receives the recognition signal from the warning notification module;

a delay module cooperating with the microprocessor to retrieve dog barking sounds from the memory and provides the dog barking sounds to the at least one of an amplifier or radio frequency transmitter a preset delay of one or more seconds after the microprocessor receives the recognition signal from the warning notification module; and a random module cooperating with the microprocessor to retrieve various dog barking sounds for a preselected dog type from the memory and provides the various dog barking sounds for the preselected dog type randomly to at least one of an amplifier or radio frequency transmitter with a delay time after the microprocessor receives the recognition signal from the warning notification module.

3. The security system of claim 2 further comprising a time out module, wherein the time out module disable operation of the microprocessor at a set time after the microprocessor first receives the recognition signal from the warning notification module.

4. The security system of claim 2 wherein the radio frequency transmitter broadcasts the dog barking sounds to at least one public radio station frequency.

5. The security system of claim 2 further comprising a microphone, wherein the microphone operates with the microprocessor and the memory to recognize door bell sounds, wherein said door bell sounds are first recognized to enable retrieval of dog barking sounds from memory and rendering of the dog barking sounds by the system via the least one of the radio frequency transmitter or the amplifier.

6. The security system of claim 2, wherein said remote wireless transmitter comprises a portable transmitter carried by a user.

7. The security system of claim 2, wherein said portable transmitter further includes buttons that allow the user to control home security system arming functionality and emergency calling functions through said personal security system.

8. A security system comprising:

a doorbell system comprising a doorbell actuator deployed near a door and a doorbell transducer that produces a doorbell sound and wherein actuating the doorbell actuator causes the doorbell transducer to emit the doorbell sound;

a remote wireless transmitter that produces an emergency transmission signal when manipulated by a person;

a warning notification module that produces a recognition signal after receiving and recognizing the emergency transmission signal;

a memory containing a plurality of dog barking sound recordings;

a microprocessor that responds to the recognition signal by retrieving a dog barking recording from the memory and providing the dog barking recording to at least one of an amplifier or a radio frequency transmitter;

a random module wherein the random module cooperates with the microprocessor to select which of the dog barking recordings is sent to the at least one of the amplifier or the radio frequency transmitter such that different receptions of the recognition signal trigger randomly select different of the dog barking recordings to be played;

a microphone that senses the doorbell sound and wherein the microprocessor operates with the microphone and the memory to produce the recognition signal upon recognizing the doorbell sound; and a delay module that causes a predetermined time delay between sensing the door bell sounds and providing the dog barking sound recordings.

9. A security system comprising:

a doorbell system comprising a doorbell actuator deployed near a door and a doorbell transducer that produces a doorbell sound and wherein actuating the doorbell actuator causes the doorbell transducer to emit the doorbell sound;

a remote wireless transmitter that produces an emergency transmission signal when manipulated by a person;

a warning notification module that produces a recognition signal after receiving and recognizing the emergency transmission signal;

a memory containing a plurality of dog barking sound recordings;

a microprocessor that responds to the recognition signal by retrieving a dog barking recording from the memory and providing the dog barking recording to at least one of an amplifier or a radio frequency transmitter;

a random module wherein the random module cooperates with the microprocessor to select which of the dog barking recordings is sent to the at least one of the amplifier or the radio frequency transmitter such that different receptions of the recognition signal trigger randomly select different of the dog barking recordings to be played;

a microphone that senses the doorbell sound and wherein the microprocessor operates with the microphone and the memory to produce the recognition signal upon recognizing the doorbell sound; and a delay module that causes a time delay of at least one second between sensing the door bell sounds and providing the dog barking sound recordings.

10. A security system comprising:

a doorbell system comprising a doorbell actuator deployed near a door and a doorbell transducer that produces a doorbell sound and wherein actuating the doorbell actuator causes the doorbell transducer to emit the doorbell sound;

a remote wireless transmitter that produces an emergency transmission signal when manipulated by a person;

a warning notification module that produces a recognition signal after receiving and recognizing the emergency transmission signal wherein the doorbell signal is an electromagnetic signal, and wherein the warning notification module produces the recognition signal after receiving and recognizing the doorbell signal;

a memory containing a plurality of dog barking sound recordings;

a microprocessor that responds to the recognition signal by retrieving a dog barking recording from the memory and providing the dog barking recording to at least one of an amplifier or a radio frequency transmitter;

a random module wherein the random module cooperates with the microprocessor to select which of the dog barking recordings is sent to the at least one of the amplifier or the radio frequency transmitter such that different receptions of the recognition signal trigger randomly select different of the dog barking recordings to be played; and a delay module that causes a predetermined time delay between recognizing the doorbell signal and providing the dog barking sound recordings.

11. A security system comprising:

a doorbell system comprising a doorbell actuator deployed near a door and a doorbell transducer that produces a doorbell sound and wherein actuating the doorbell actuator causes the doorbell transducer to emit the doorbell sound;

a remote wireless transmitter that produces an emergency transmission signal when manipulated by a person;

a warning notification module that produces a recognition signal after receiving and recognizing the emergency transmission signal wherein the doorbell signal is an electromagnetic signal, and wherein the warning notification module produces the recognition signal after receiving and recognizing the doorbell signal;

a memory containing a plurality of dog barking sound recordings;

a microprocessor that responds to the recognition signal by retrieving a dog barking recording from the memory and providing the dog barking recording to at least one of an amplifier or a radio frequency transmitter;

a random module wherein the random module cooperates with the microprocessor to select which of the dog bark ing recordings is sent to the at least one of the amplifier or the radio frequency transmitter such that different receptions of the recognition signal trigger randomly select different of the dog barking recordings to be played; and a delay module that causes a time delay of at least one second between recognizing the doorbell signal and providing the dog barking sound recordings.

* * * * *